US006279890B1

(12) United States Patent
Tomczak

(10) Patent No.: US 6,279,890 B1
(45) Date of Patent: Aug. 28, 2001

(54) COMBINATION ROTARY AND JAW FOLDER FOR A PRINTING PRESS

(75) Inventor: Charles Tomczak, Naperville, IL (US)

(73) Assignee: Goss Graphic Systems, Inc., Westmont, IL (US)

( * ) Notice: Subject to any disclaimer, the term of this patent is extended or adjusted under 35 U.S.C. 154(b) by 0 days.

(21) Appl. No.: 09/546,499

(22) Filed: Apr. 11, 2000

(51) Int. Cl.[7] ..... B41F 13/56

(52) U.S. Cl. ..... 270/21.1; 270/20.1; 101/227; 101/232; 493/425; 493/427; 493/429; 493/431; 493/432; 493/434; 493/440; 493/476

(58) Field of Search ..... 270/5.02, 6, 7, 270/8, 20.1, 21.1, 58.29; 493/426, 427, 428, 476, 442, 443, 424, 431, 440, 429, 425, 432, 434; 101/216, 227, 232; 271/187

(56) References Cited

U.S. PATENT DOCUMENTS

| | | | | |
|---|---|---|---|---|
| 408,390 | * | 8/1889 | Tucker | 493/440 |
| 658,209 | | 9/1900 | Firm . | |
| 1,791,694 | | 2/1931 | Wood . | |
| 1,870,544 | | 8/1932 | Wood . | |
| 3,083,010 | | 3/1963 | Salmon et al. . | |
| 3,986,111 | * | 10/1976 | Anlkanov et al. | 493/431 |
| 4,273,320 | * | 6/1981 | Fijishirio | 493/427 |
| 4,279,410 | * | 7/1981 | Bolza-Schünemann | 493/427 |
| 4,386,879 | * | 6/1983 | Hoshi | 493/432 |
| 4,391,596 | * | 7/1983 | Fischer | 493/432 |
| 4,537,390 | * | 8/1985 | Kiamco et al. | 270/58.29 |
| 4,564,470 | * | 1/1986 | Schmitt | 270/21.1 |
| 4,781,667 | * | 11/1988 | Kitai | 493/434 |
| 4,863,307 | * | 9/1989 | Crotatt et al. | 271/187 |
| 5,049,120 | | 9/1991 | Prüm . | |
| 5,072,919 | * | 12/1991 | Schneider | 270/21.1 |
| 5,226,871 | | 7/1993 | Skipor . | |
| 5,425,697 | | 6/1995 | Lanvin . | |
| 5,439,206 | * | 8/1995 | Raasch et al. | 493/440 |
| 5,443,437 | * | 8/1995 | Mack et al. | 493/427 |
| 5,522,586 | * | 6/1996 | Bennett et al. | 493/429 |
| 5,527,256 | | 6/1996 | Vauchelle et al. . | |
| 5,547,452 | | 8/1996 | Kepert et al. . | |
| 5,551,678 | | 9/1996 | Michalik et al. . | |
| 5,653,429 | * | 8/1997 | Michalik | 270/261 |
| 5,707,330 | | 1/1998 | Kiamco et al. . | |
| 5,730,056 | * | 3/1998 | Schmitt | 101/232 |
| 5,797,319 | | 8/1998 | Tomczak . | |
| 5,846,177 | * | 12/1998 | Mayr | 493/429 |
| 5,901,647 | * | 5/1999 | Kohlmann | 101/227 |
| 5,921,906 | * | 7/1999 | Nagano | 493/429 |
| 6,093,139 | * | 7/2000 | Bolanger | 493/426 |

* cited by examiner

*Primary Examiner*—Eugene Eickholt
(74) *Attorney, Agent, or Firm*—Marshall, O'Toole, Gerstein, Murray & Borun

(57) ABSTRACT

A printing press having a jaw mode assembly and a rotary mode assembly with a single folding cylinder adapted to feed either the jaw mode assembly or the rotary mode assembly is disclosed. A moving web of material is initially trained about the folding cylinder and cut into a signatures which are then temporarily held on the folding cylinder. A folding blade extends from the folding cylinder to initiate a fold in each signature and direct each signature to either the jaw mode assembly or the rotary mode assembly. The timing of the folding blade is coordinated and adjusted using an indexable spider assembly to feed either the jaw mode assembly or the rotary mode assembly.

25 Claims, 18 Drawing Sheets

COMBINATION ROTARY AND JAW FOLDER FOR A PRINTING PRESS

FIELD OF THE INVENTION

The present invention generally relates to printing presses and, more particularly, relates to printing presses adapted to fold signatures cut from a moving web of printed material.

BACKGROUND OF THE INVENTION

Signatures produced from printing presses, such as those for newspapers, periodicals, and catalogs are typically cut from a moving web of printed material traversed through the printing press. After the cut, the signature is typically folded at least once to produce the desired configuration for the end product.

The printing press industry has typically employed one of two mechanisms for creating a fold within a signature cut from a moving web. One of the known mechanisms for creating the fold is referred to as a rotary folder or couple, wherein a pair of second fold rollers are positioned proximate a folding cylinder with a gap or nip being provided between the second fold rollers. The web of material is wrapped around the folding cylinder and a folding blade is adapted to extend from the folding cylinder in a position corresponding to the nip. The folding blade is typically mounted to a spider assembly used to appropriately time the extension of the folding blade. When a folding blade extends from the folding cylinder, the folding blade extends into the nip, pushing the signature cut from the web into the nip. The second fold rollers, which rotate away from the folding cylinder, complete the fold in the signature initiated by the folding blade, and process the folded signature on to a delivery system including such things as delivery flies and conveyor belts.

Another known type of folding couple is referred to as a jaw folder wherein a jaw cylinder is positioned proximate the folding cylinder with a plurality of jaws or clamp assemblies positioned around the periphery of the jaw cylinder. The timing of the rotating jaw cylinder is coordinated with the rotation and extension of the folding blade from the folding cylinder such that when the folding blade extends from the folding cylinder, the folding blade extends into one of the jaws or clamp assemblies on the jaw cylinder. This in turn pushes the fold of the signature into the jaw or clamp to complete the fold. The jaw is then released to allow the folded signature to be transported away by a delivery system. Examples of such jaw cylinders are disclosed in U.S. Pat. Nos. 5,226,871, 5,522,586, and 5,797,319, the disclosures of each being herein incorporated by reference.

While such systems continue to be used, certain production criteria necessitate the need for one or the other type of folding couple. For example, rotary folders have proven to be extremely rugged and durable and thus are often preferred by facilities wherein it is desirable to produce a large quantity of product on a daily basis, such as with a newspaper. However, jaw folders have proven to be more accurate and to result in minimized marking on the signatures and thus are more desirable in situations wherein extremely high quality and accuracy are at a premium, such as with magazines and catalogs.

Some printing presses are equipped with both mechanisms. However, such presses are relatively expensive in that, among other things, two separate folding couples need to be provided. This includes additional frames, drive shafts, drive gearing, delivery flies, and conveyors. In addition, since the hardware for both the rotary folder and jaw folder are provided on the same press, regardless of which is being used, the mechanics of the resulting press are tightly grouped, with little access room being provided in the press for maintenance and the like.

SUMMARY OF THE INVENTION

In accordance with one aspect of the invention, a printing press folding system is provided which includes a frame, a folding cylinder mounted to the frame, a jaw cylinder mounted to the frame, and a rotary mode assembly mounted to the frame. A moving web of printed material is adapted to traverse through the printing press and be cut into individual signatures. The folding cylinder is adapted to receive the signatures and includes a folding blade adapted to extend radially therefrom to initiate a fold in each signature. The folding cylinder is configurable into a rotary mode or a jaw mode. The jaw cylinder is positioned proximate the folding cylinder and includes a plurality of clamp assemblies extending radially therefrom, each clamp assembly being adapted to receive the folding blade and a folded signature therein when the folding cylinder is in the jaw mode. The rotary mode assembly includes a pair of second fold rollers separated by a nip which is adapted to receive the folding blade and a signature therein when the folding cylinder is in the rotary mode.

In accordance with other aspects of the invention, the folding blade may be connected to a timing mechanism which is adjustable to cause a folding blade to extend either into one of the clamp assemblies when in the jaw mode, or into the nip when in the rotary mode. The timing mechanism may include a planetary gear system.

In accordance with another aspect of the invention, a folding couple for a printing press is provided which includes a rotary mode assembly, a jaw mode assembly, and means for directing a fold in a signature to either the rotary mode assembly or the jaw mode assembly.

In accordance with yet another aspect of the invention, a method of producing folded signatures from a moving web is provided including the steps of cutting the moving web into signatures, creating a fold in the signature, and directing the fold to a rotary mode assembly or a jaw mode assembly wherein the rotary mode assembly and jaw mode assembly are provided on the same folding couple.

These and other aspects and features of the present invention will become more apparent from the following detailed description when taken in conjunction with the accompanying drawings.

Figure 1:
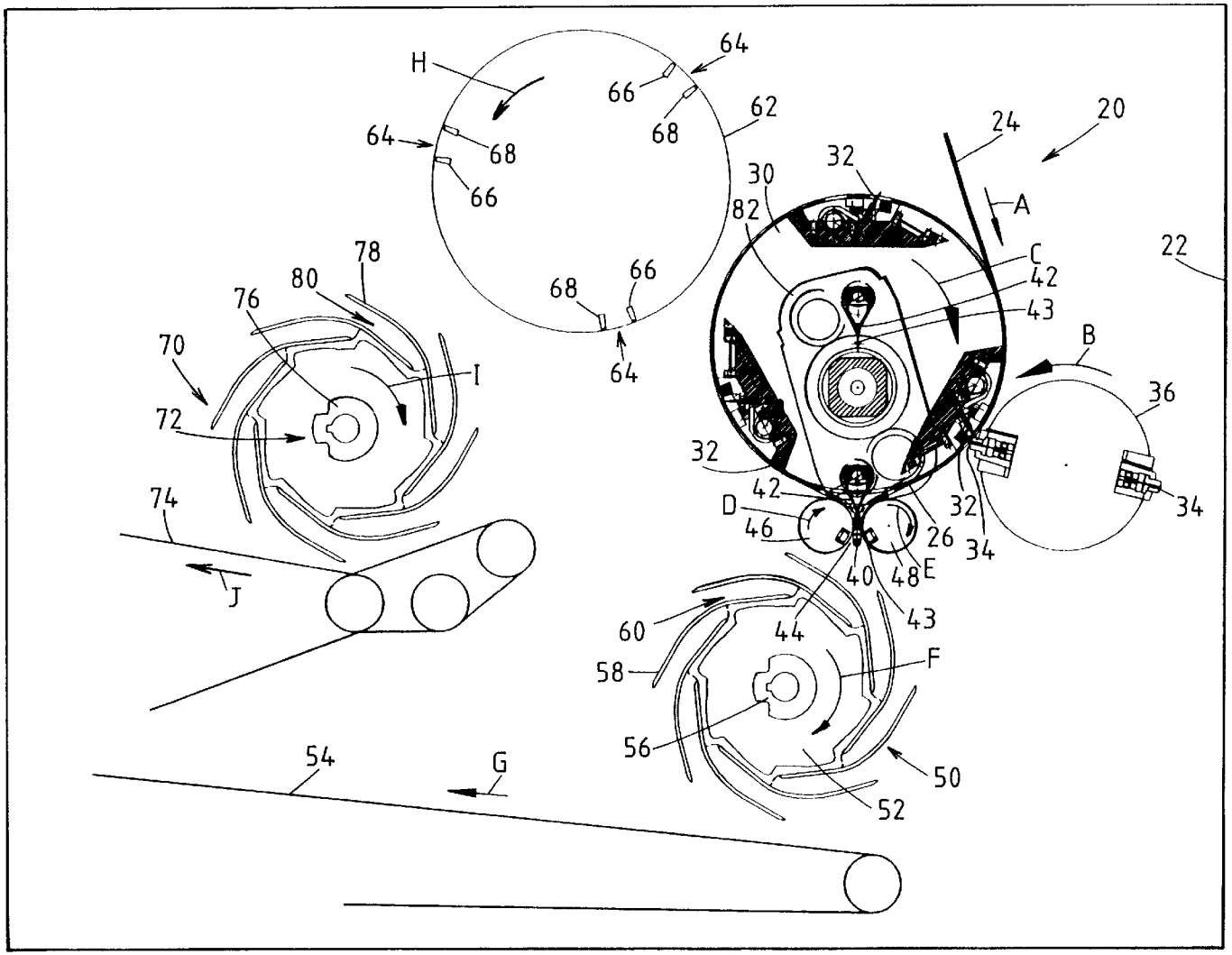
FIG. 1 is a schematic representation of a printing press according to the invention configured into a rotary mode.

While the invention is susceptible to various modifications and alternative constructions, certain illustrative embodiments thereof have been shown in the drawings and will be described below in detail. It should be understood, however that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENTS

Figure 2:
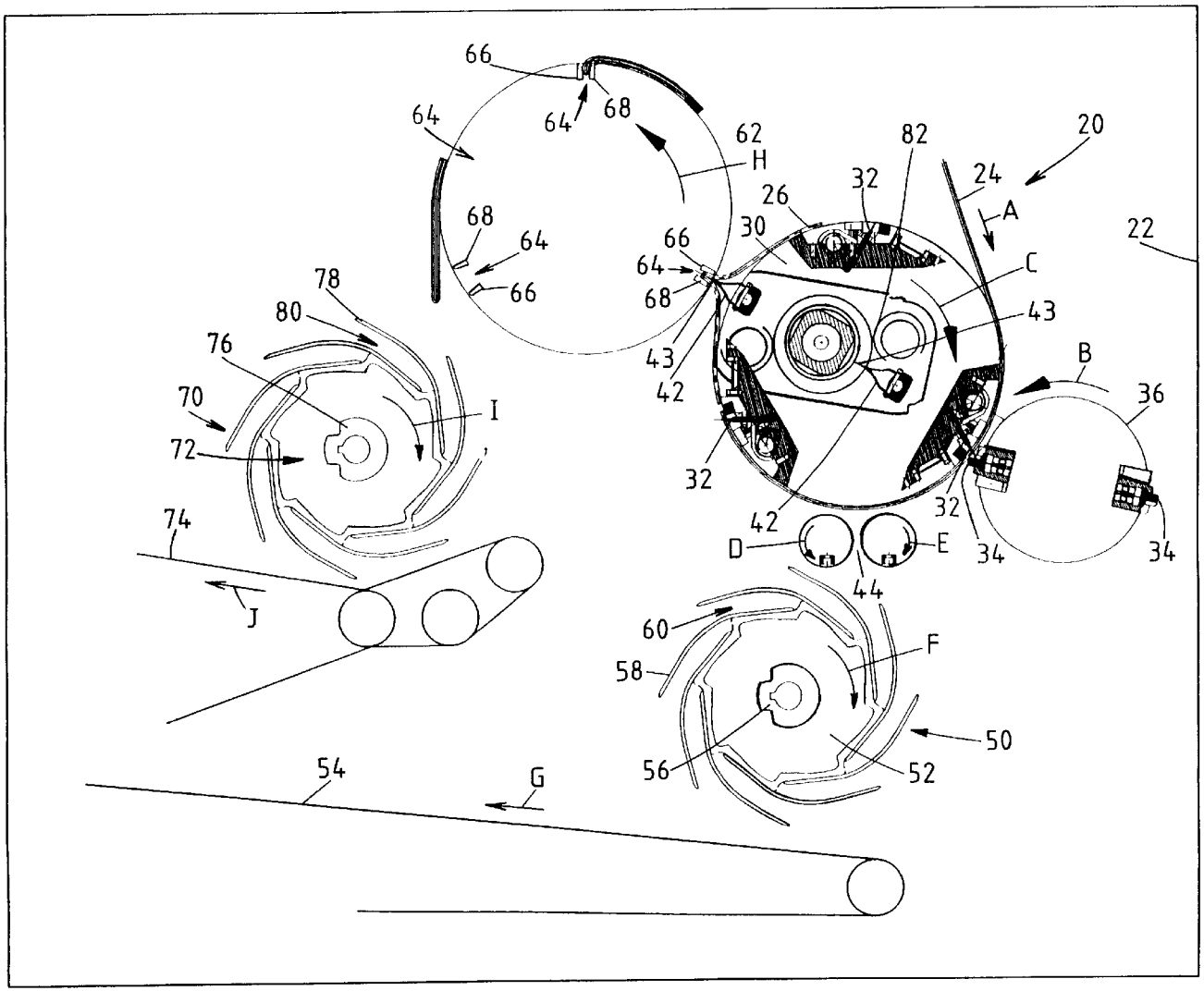
FIG. 2 is a schematic representation of a printing press according to the invention configured into a jaw mode.

Referring now to the drawings, and with specific reference to FIGS. 1 and 2, a printing press folder according to the present invention is generally depicted by reference numeral 20. As shown therein, the printing press folder 20 includes a frame 22 relative to which a moving web 24 is adapted to move. While not depicted, it is to be understood that the web 24 is typically provided in the form of a wound roll of paper which is threaded and pulled through the printing press folder 20 to have various printing procedures performed thereon. Once printed, the web 24 is cut into signatures 26 and folded into end units 28.

Figure 3:
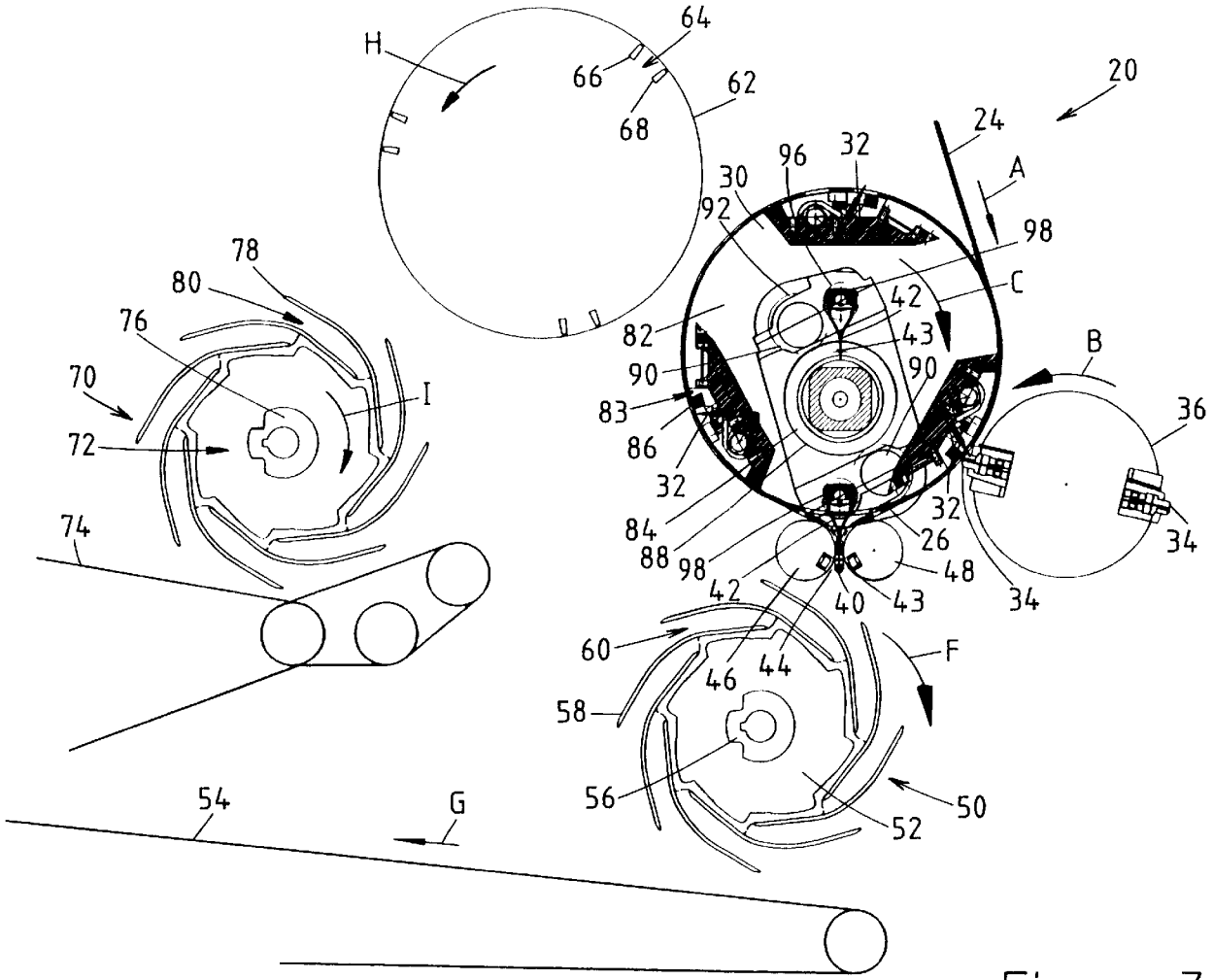
FIG. 3 is a schematic representation of a printing press according to the invention, depicting a spider motion that is typical in the industry but which is timed in accordance with the invention to cooperate with a rotary mode assembly.

First with regard to FIG. 1, the rotary mode into which the printing press folder 20 can be configured is shown. The web 24, moving in the direction of arrow A, is initially wrapped partially around a folding cylinder 30 and held thereto by a first set of pins 32 (FIG. 3). As will be described in further detail herein, the first set of pins 32 are timed to extend from the folding cylinder 30 prior to cutting, and retract into the folding cylinder 30 prior to folding. A second set of pins 32 (FIG. 3) is provided to hold the web 24 to the folding cylinder 30 after the signature 26 is cut. A third set of pins 32 (FIG. 3) is also provided so as to allow for continuous operation more fully described below.

After the first set of pins 32 have extended from the folding cylinder 30 and into the web 24, the web 24 is cut into signatures 26 by cutting blades 34 extending radially from a cutting cylinder 36. In the depicted embodiment, the cutting cylinder 36 rotates counterclockwise (arrow B) and the folding cylinder 30 rotates clockwise (arrow C). The cutting blades 34 cooperate with anvils 38 provided on the folding cylinder 30 to create the signatures 26. After the cut is made the web 24 continues to be held to the folding cylinder 30 by the second set of pins 32 (See FIG. 3).

As best shown by FIGS. 5A–G, when the press 20 is in the rotary mode, a fold 40 is created in the signature 26 simultaneously with the cut being made by the extension of one of two sets of folding blades 42 from the folding cylinder 30. The extension of the first set of folding blades 42 causes the tips 43 of the blades 42 to create the fold 40 (FIG. 5B) and push the fold 40 of the signature 26 into a nip 44 provided between a pair of second fold rollers 46 and 48. Once the signature 26 is frictionally gripped in the nip 44, rotation of the first and second fold rollers 46 and 48 in the directions indicated by arrows D and E, respectively, in FIG. 1, causes the signature 26 to be pulled away from the folding cylinder 30. This motion completes the fold 40 and results in a folded signature or end unit 28. The first set of pins 32 are retracted in a timely fashion along with the extension of the first set of folding blades 42 to free the signature during folding.

Below the folding cylinder 30, a delivery system 50 is provided. The delivery system 50 includes a delivery fly 52 above an exit conveyor 54. The delivery fly 52 includes a rotating hub 56 from which a plurality of arcuate vanes 58 extend. Each pair of adjacent arcuate vanes 58 defines a pocket 60 adapted to receive an end unit 28. Rotation of the delivery fly 52 in the direction indicated by arrow F causes the end unit 28 to be deposited upon the exit conveyor 54 with the folds 40 facing forward for transportation to downstream equipment (not shown) in the direction of arrow G.

Referring now to FIG. 2, the printing press folder 20 is shown configured into a jaw mode. It will be noted that the equipment associated with the rotary mode remains positioned proximate the folding cylinder 30, but that the first and second sets of folding blades 42, when the printing press folder 20 is in the jaw mode, extend in a different rotational position than in the rotary mode. The timing mechanism to accomplish such a difference in the extension of the sets of folding blades 42 will be discussed in further detail herein. A second timing mechanism is provided to coordinate extension and retraction of the first, second and third sets of pins 32.

FIGS. 6A–G depicts the jaw mode assembly in various stages of operation. As shown therein, a jaw cylinder 62 is provided proximate the folding cylinder 30 and adapted to rotate in the direction of arrow H (see FIG. 2). The jaw cylinder 62 includes a plurality of jaw clamps 64 radially extending therefrom. The jaws 64 include first and second clamp arms 66 and 68 which are adapted to close and open to grip folds 40 created in signatures 26. The rotation of the jaw cylinder 62 is timed such that one of the sets of the folding blades 42 extends and pushes the fold 40 into one of the clamps 64 as both rotate. Further rotation of the jaw cylinder 62, after a signature 26 has been clamped, completes the fold 40, resulting in the end unit 28.

The end unit 28 is delivered by the jaw cylinder 62 to a second delivery system 70. The delivery system 70 includes a delivery fly 72 positioned above an exit conveyor 74. The delivery fly 72 includes a hub 76 from which a plurality of arcuate vanes 78 extend. Each adjacent pair of arcuate vanes 78 defines a pocket 80 adapted to receive an end unit 28. Rotation of the delivery fly 72 in the direction indicated by arrow I causes the end units 28 to be deposited upon the exit conveyor 74, which transports the end units 28 in the direction indicated by arrow J.

From FIGS. 1 and 2, it can be seen that using a single folding cylinder 30, the printing press folder 20 can be configured from a rotary mode to a jaw mode. In the rotary mode, the hardware associated with the jaw mode is not utilized. Similarly, when the printing press 20 is in the jaw mode, the hardware associated with the rotary mode is not utilized. It is important to note that the printing press folder 20 can be purchased and installed with the hardware associated with rotary mode only, the jaw mode only, or both. In any scenario, only a single folding cylinder 30 is needed, thus reducing cost, and enhancing accessibility.

The first and second sets of folding blades 42, as indicated above, can be configured to extend from the folding cylinder 30 at different rotational positions and at various intervals through the use of a timing mechanism 82. The timing mechanism 82, referred to as a spider assembly, is adapted to extend the folding blades 42 radially outward, as shown in FIGS. 1 and 2, upon every 120° of rotation of the folding cylinder 30.

Figure 4:
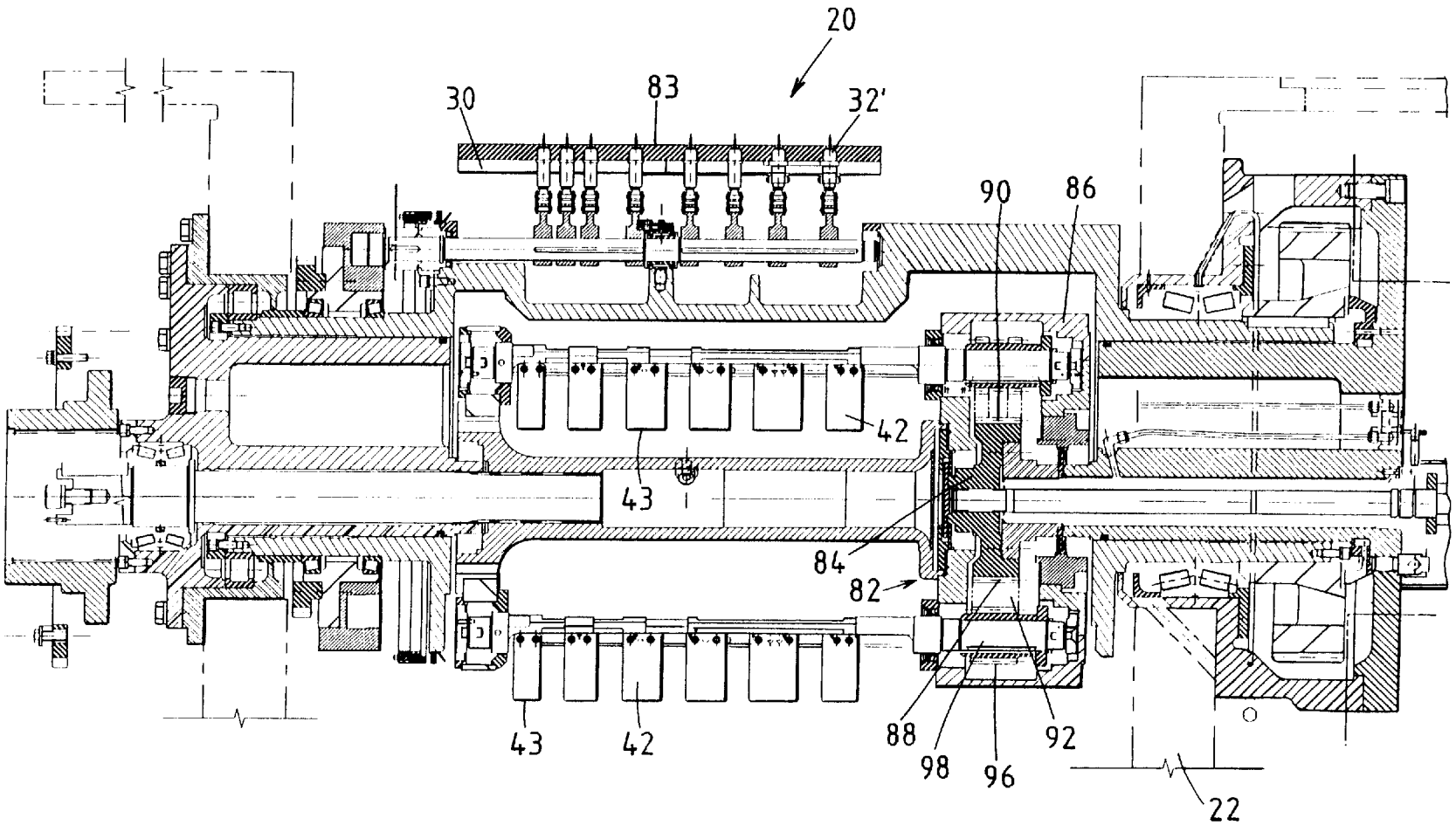
FIG. 4 is a side sectional view through a folding cylinder and spider assembly typical of rotary folders currently existing in newspaper printing plants, and used by the invention.
Figure 5A:
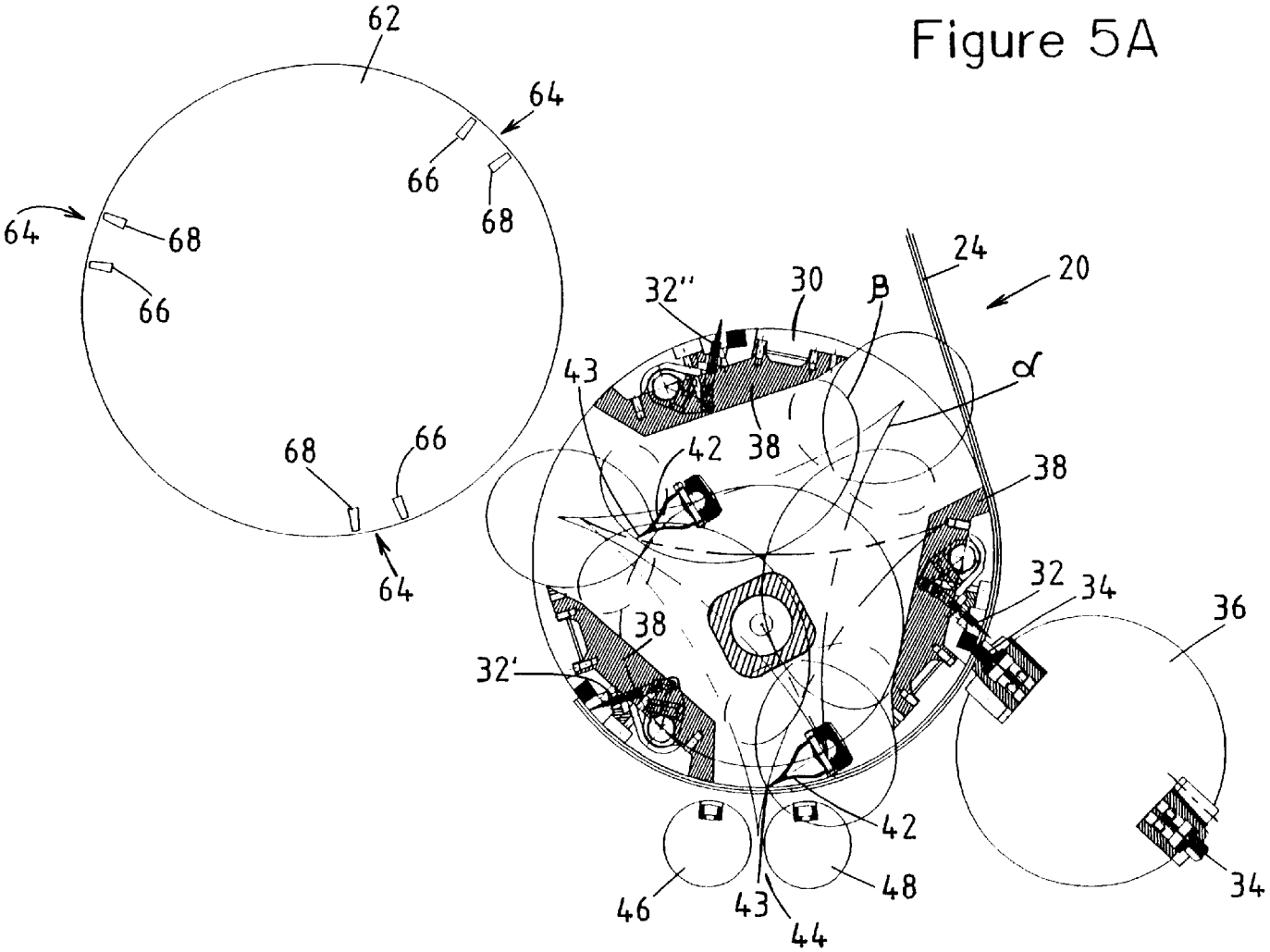
FIGS. 5A–G are schematic representations of a printing press according to the invention in sequenced stages of operation in the rotary mode.
Figure 5B:
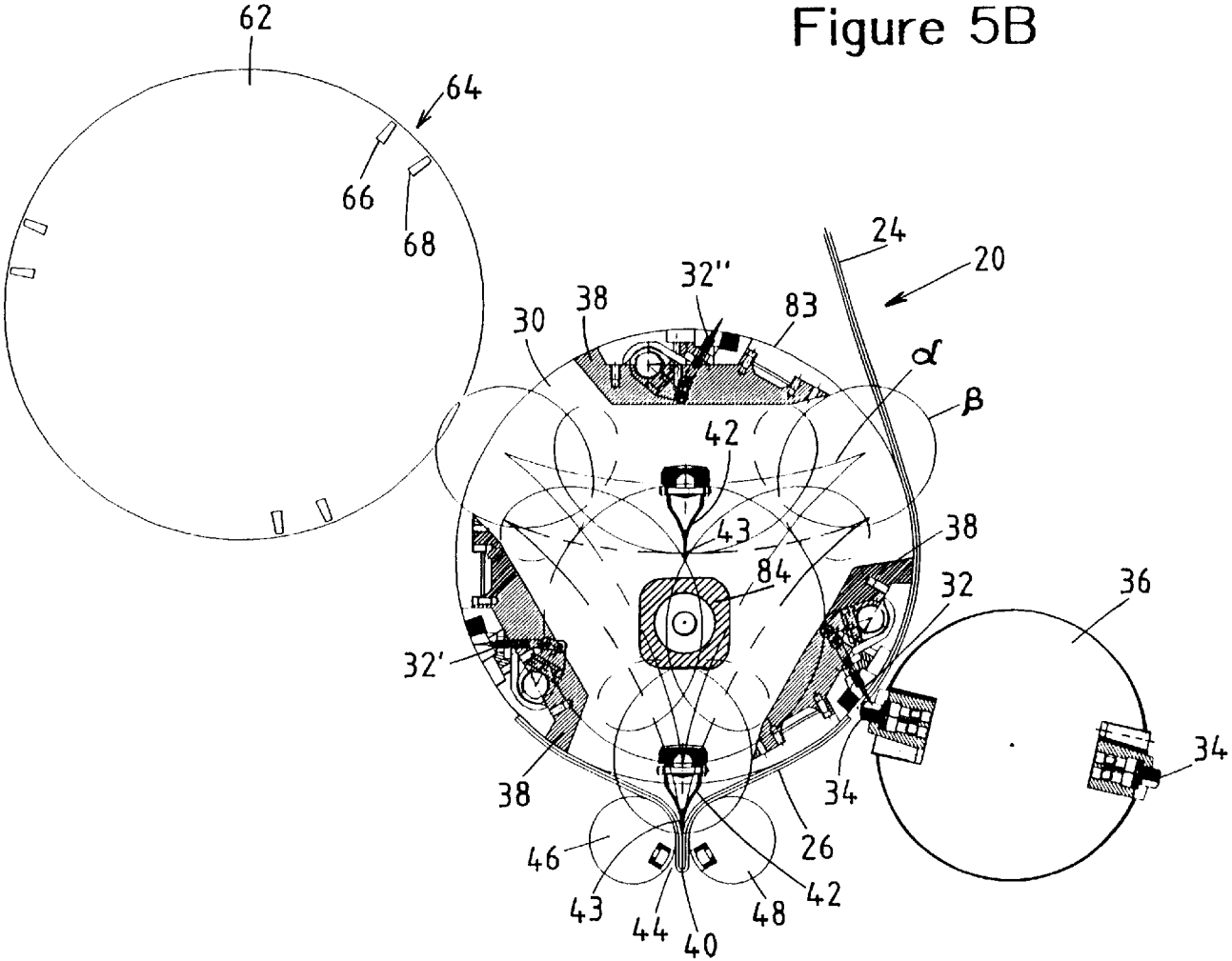
Figure 5C:
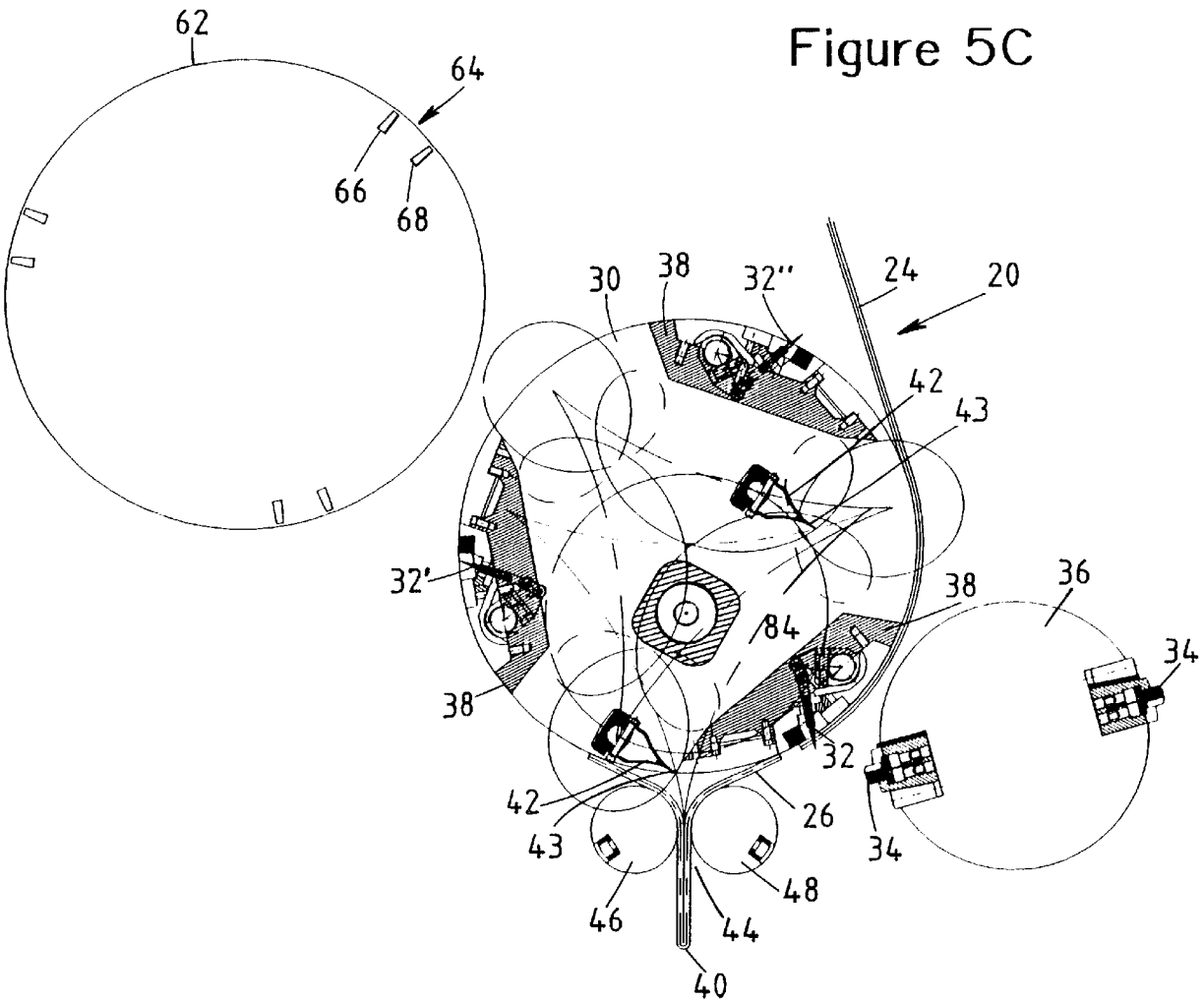
Figure 5D:
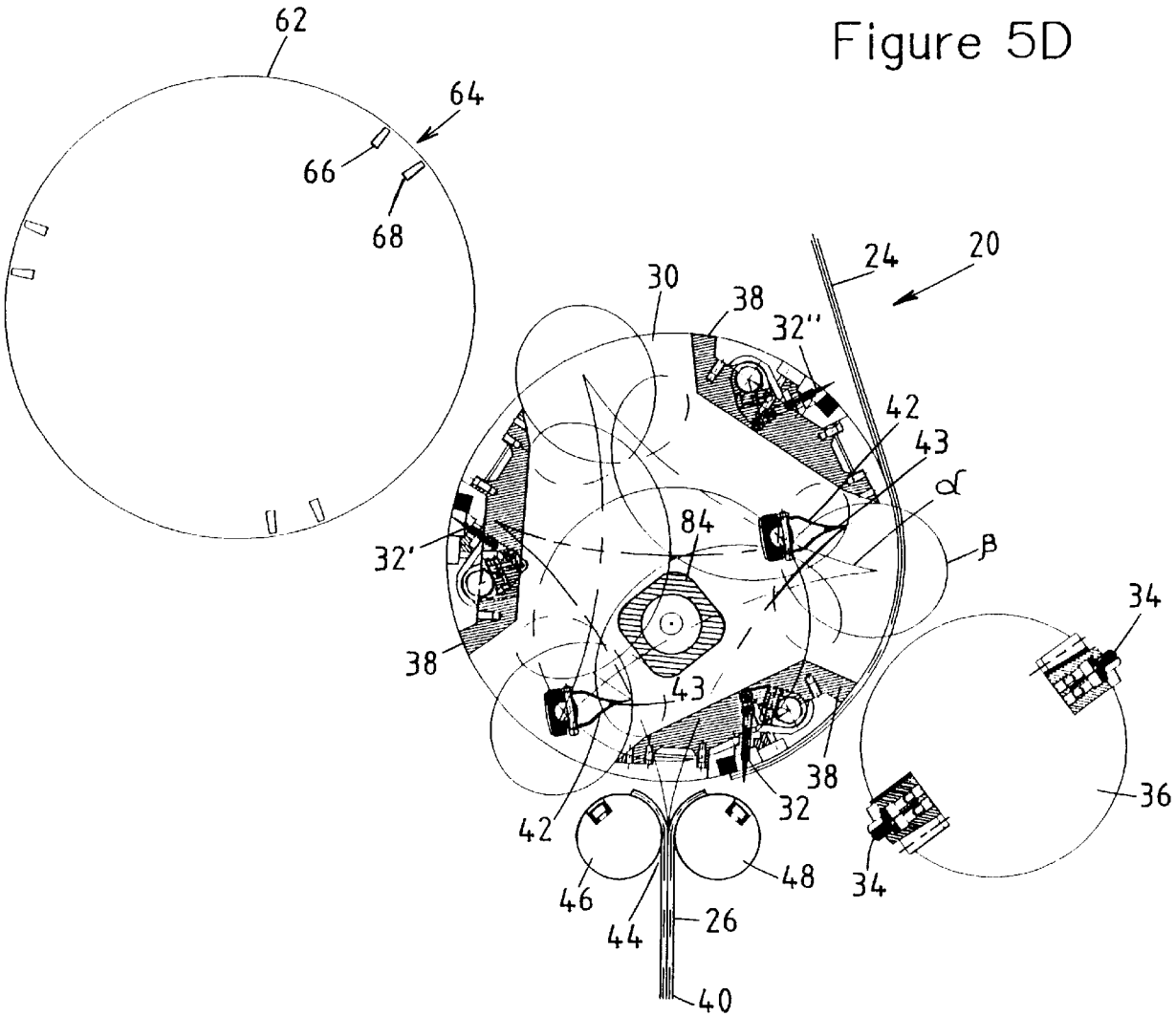
Figure 5E:
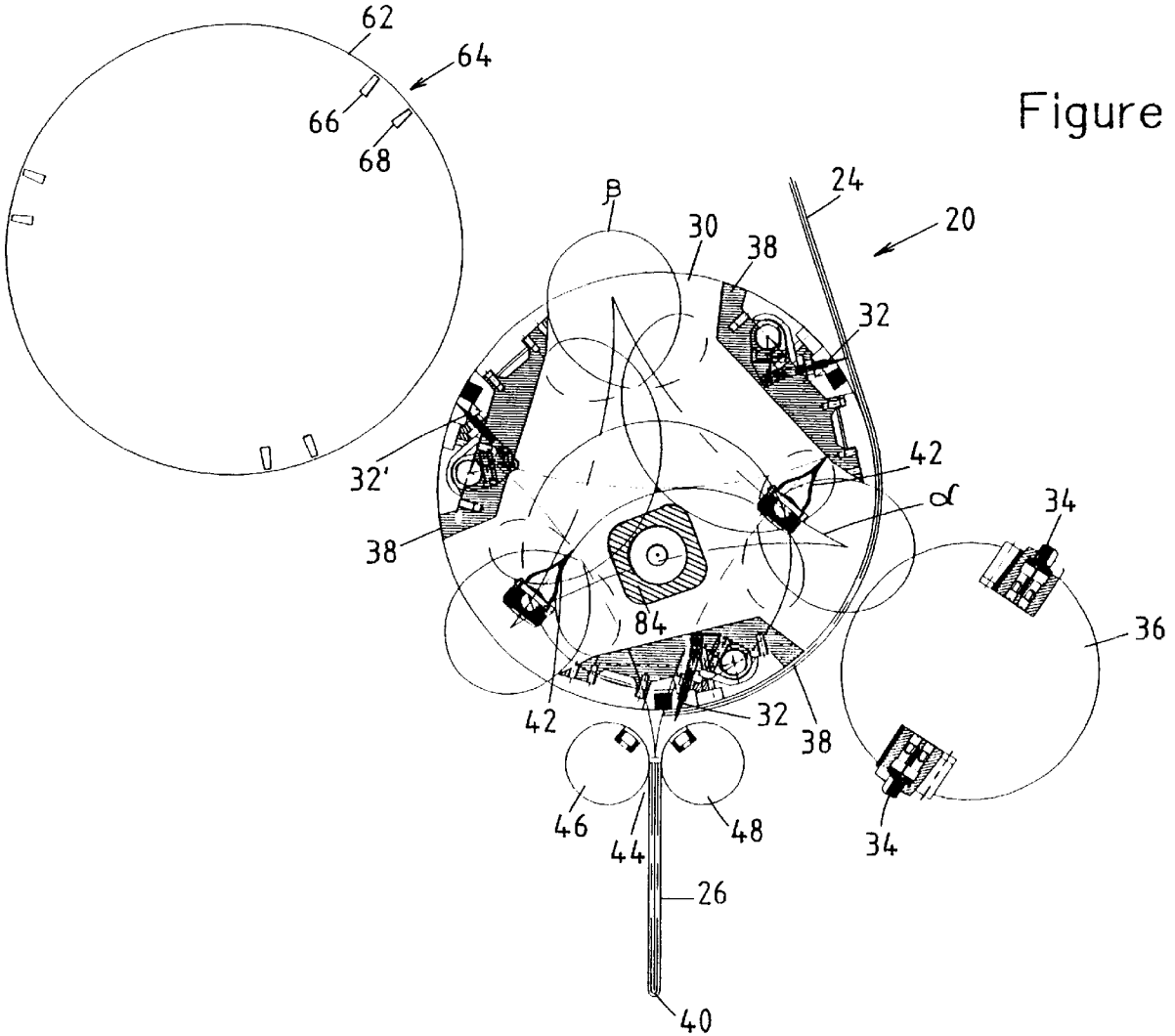
Figure 5F:
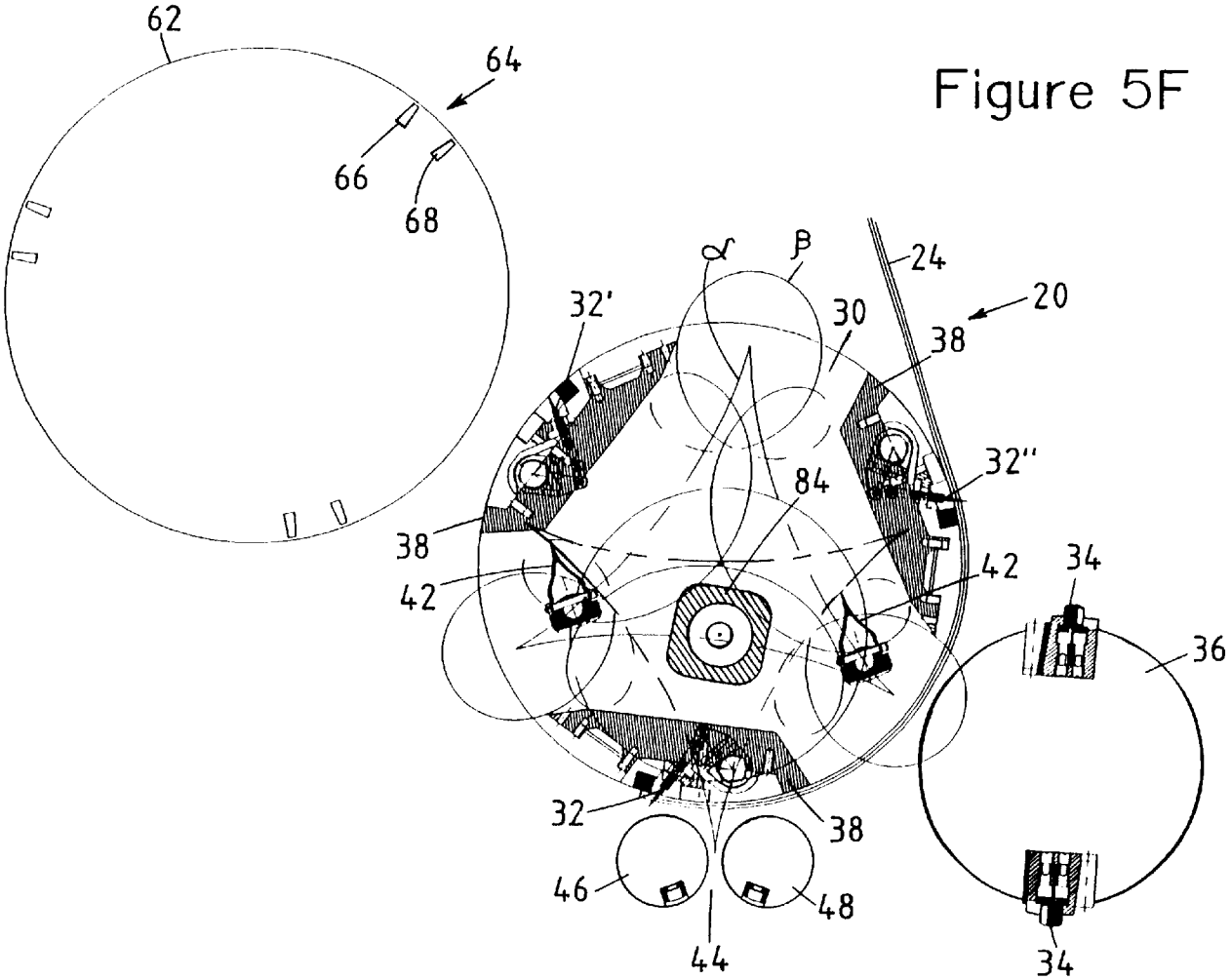
Figure 5G:
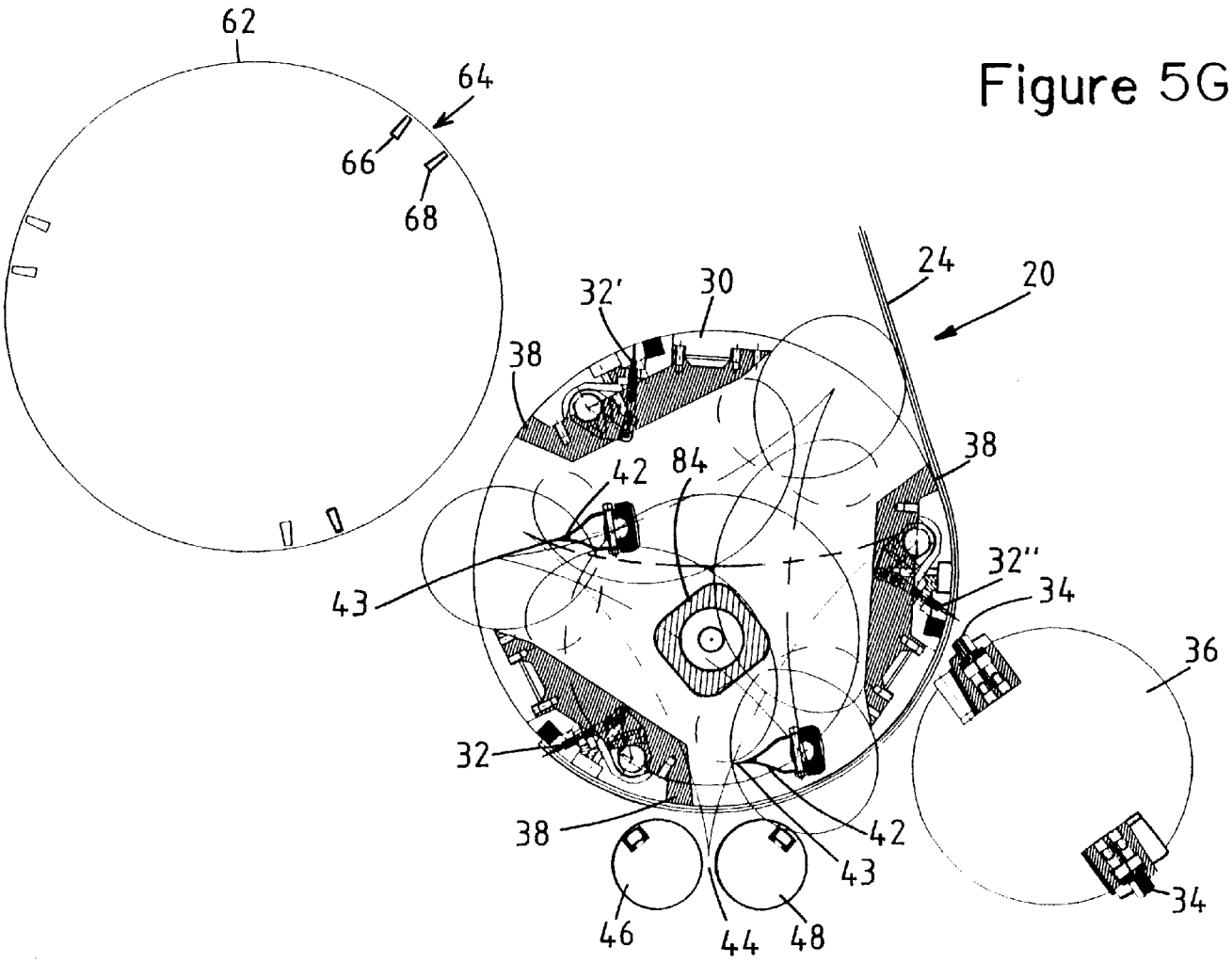
Figure 6A:
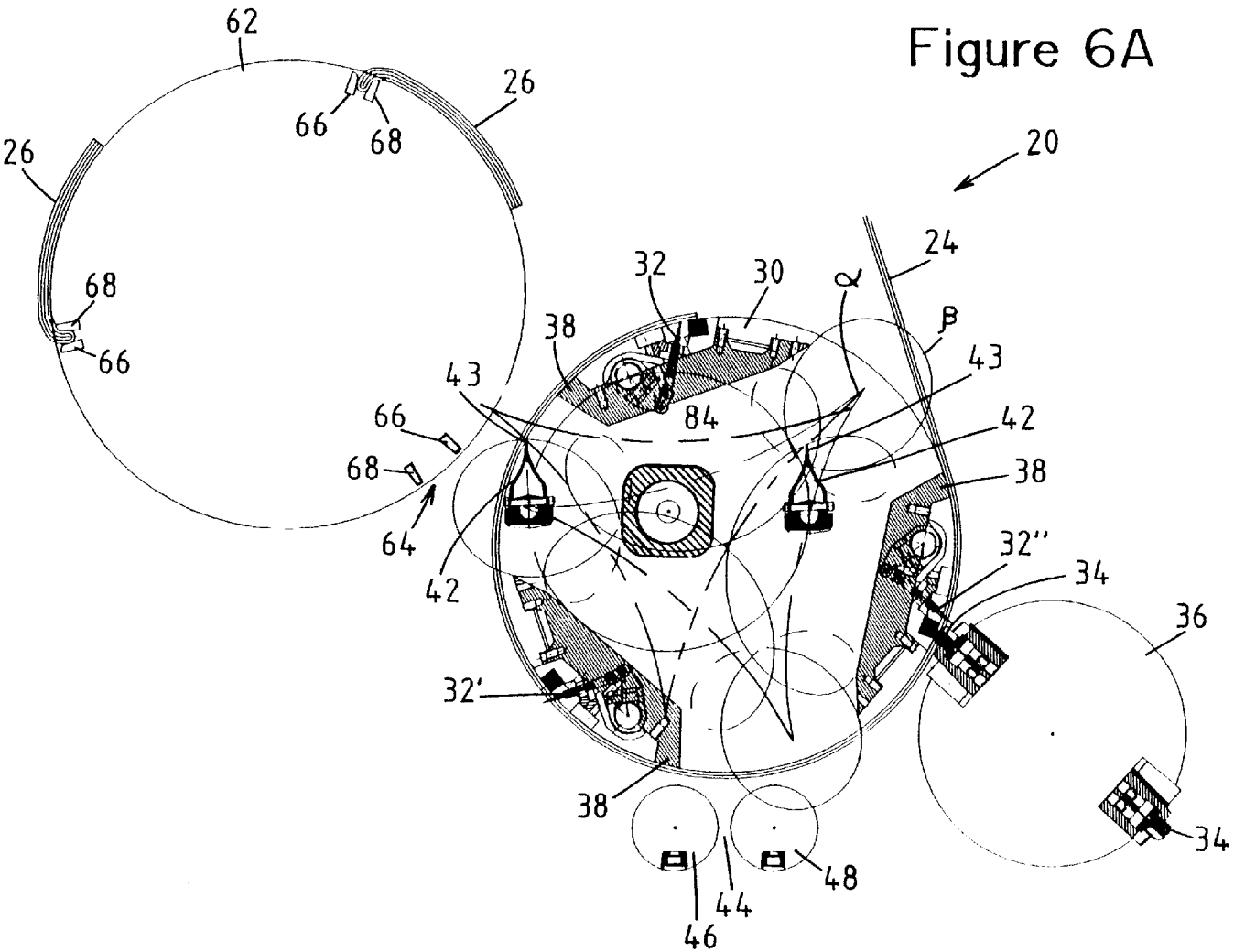
FIGS. 6A–G are schematic representations of a printing press according to the invention in sequenced stages of operation in the jaw mode.
Figure 6B:
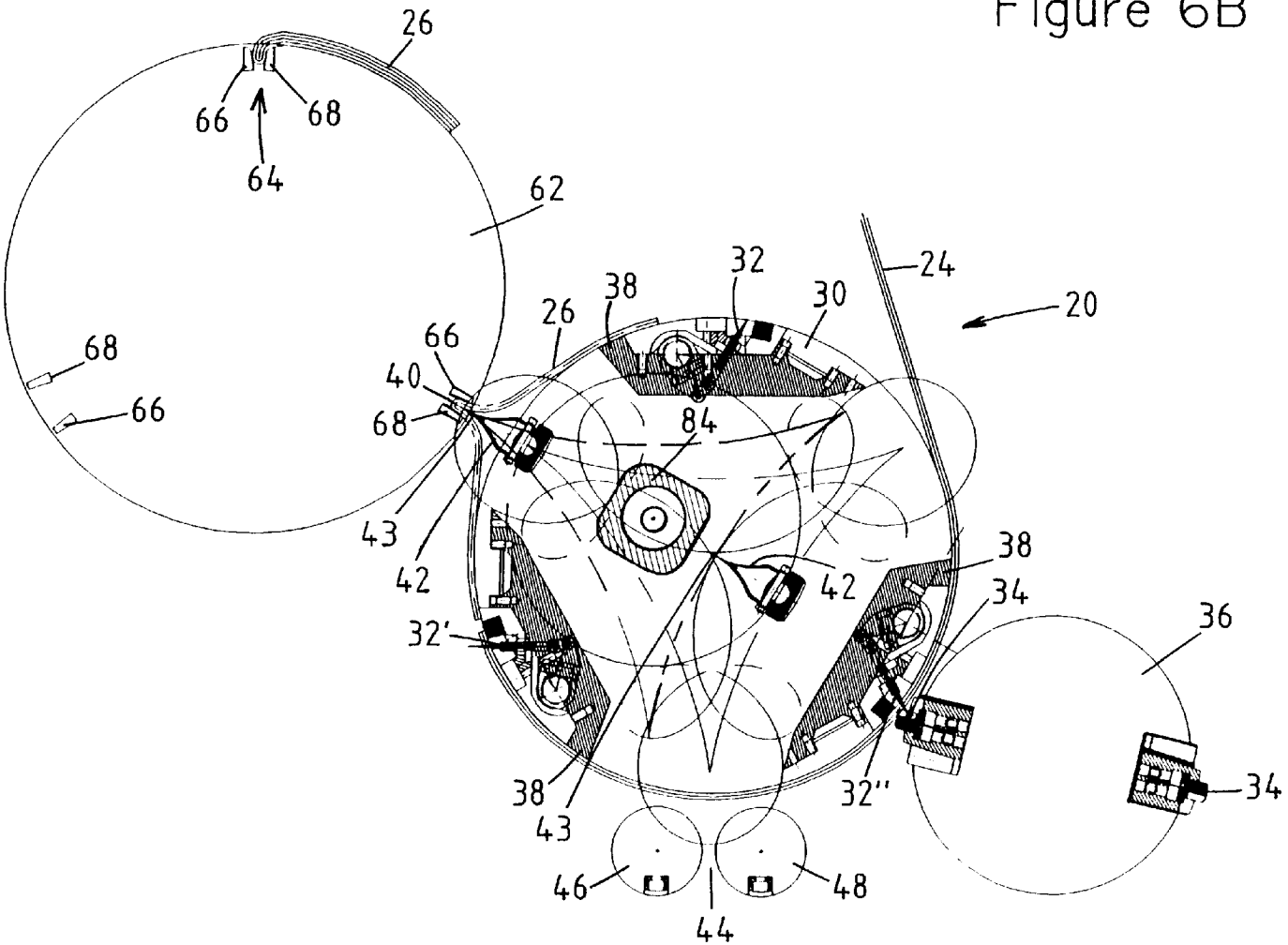
Figure 6C:
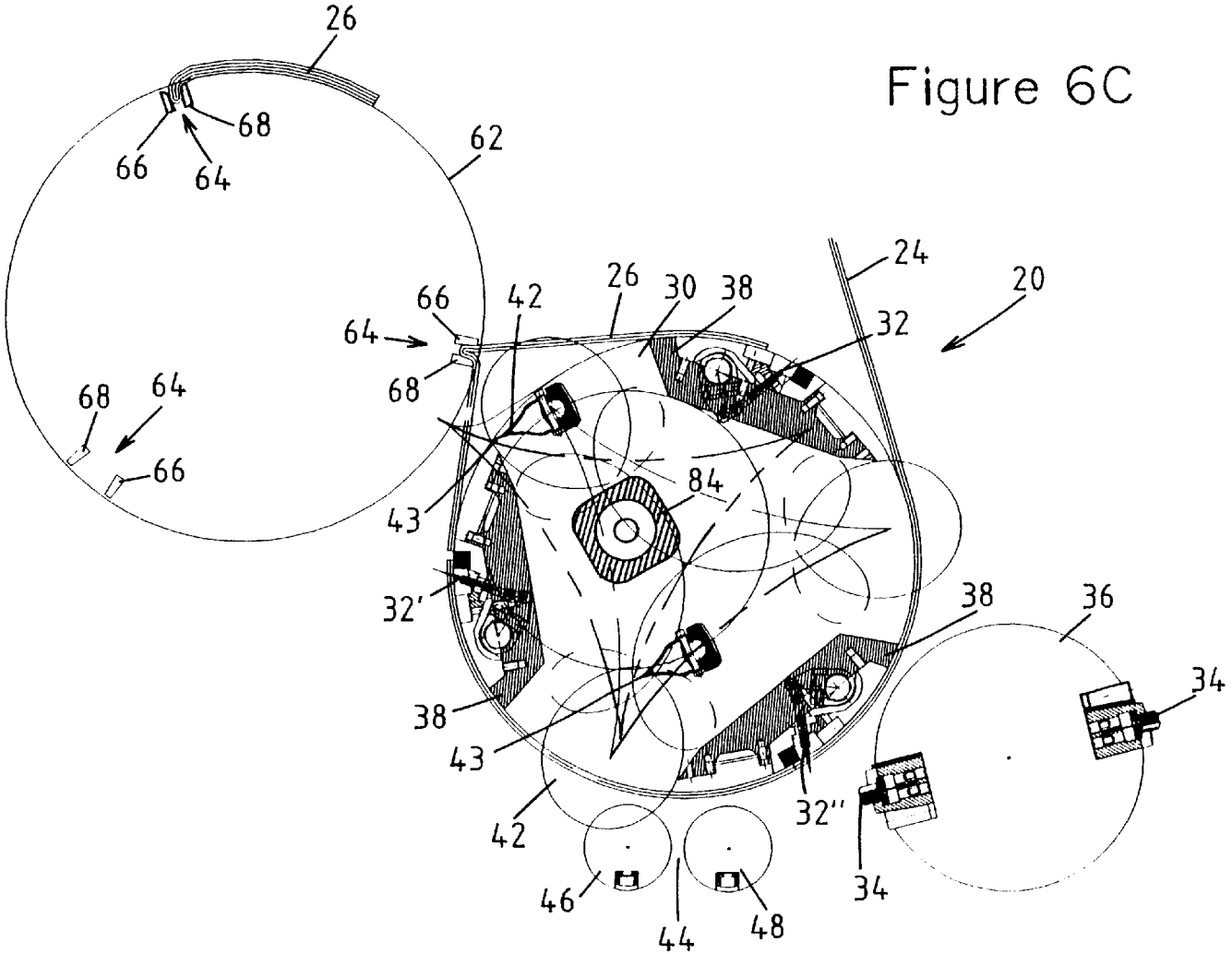
Figure 6D:
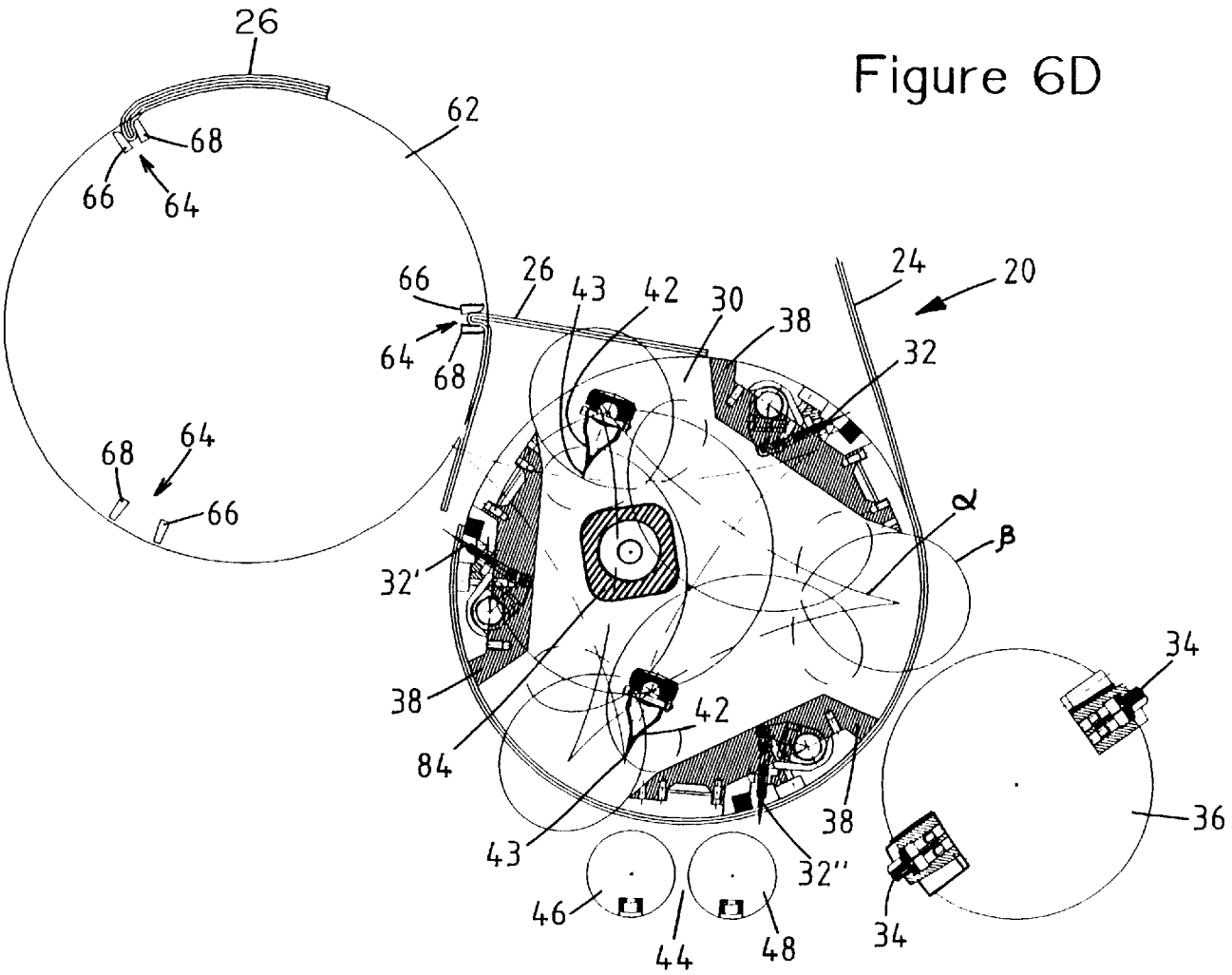
Figure 6E:
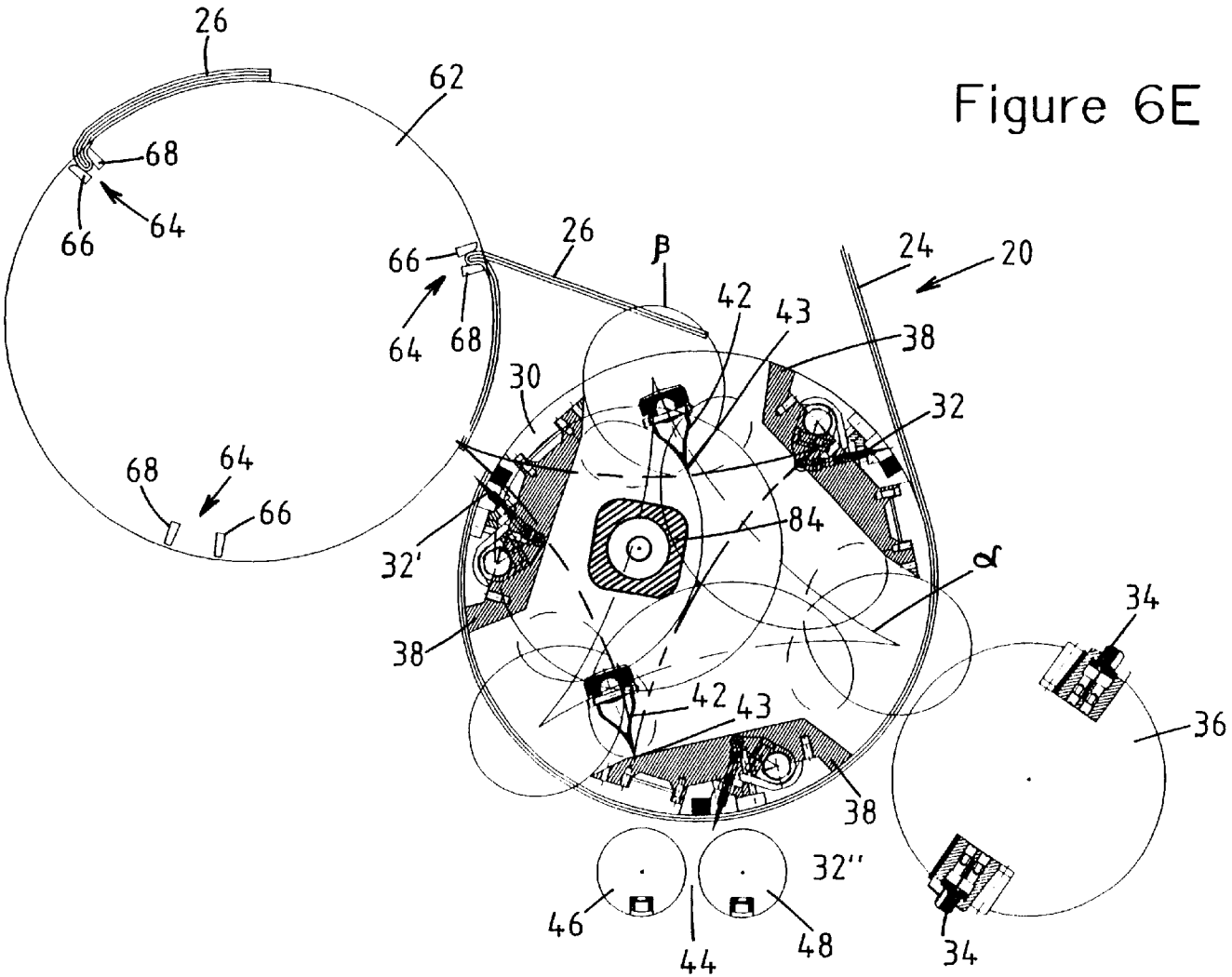
Figure 6F:
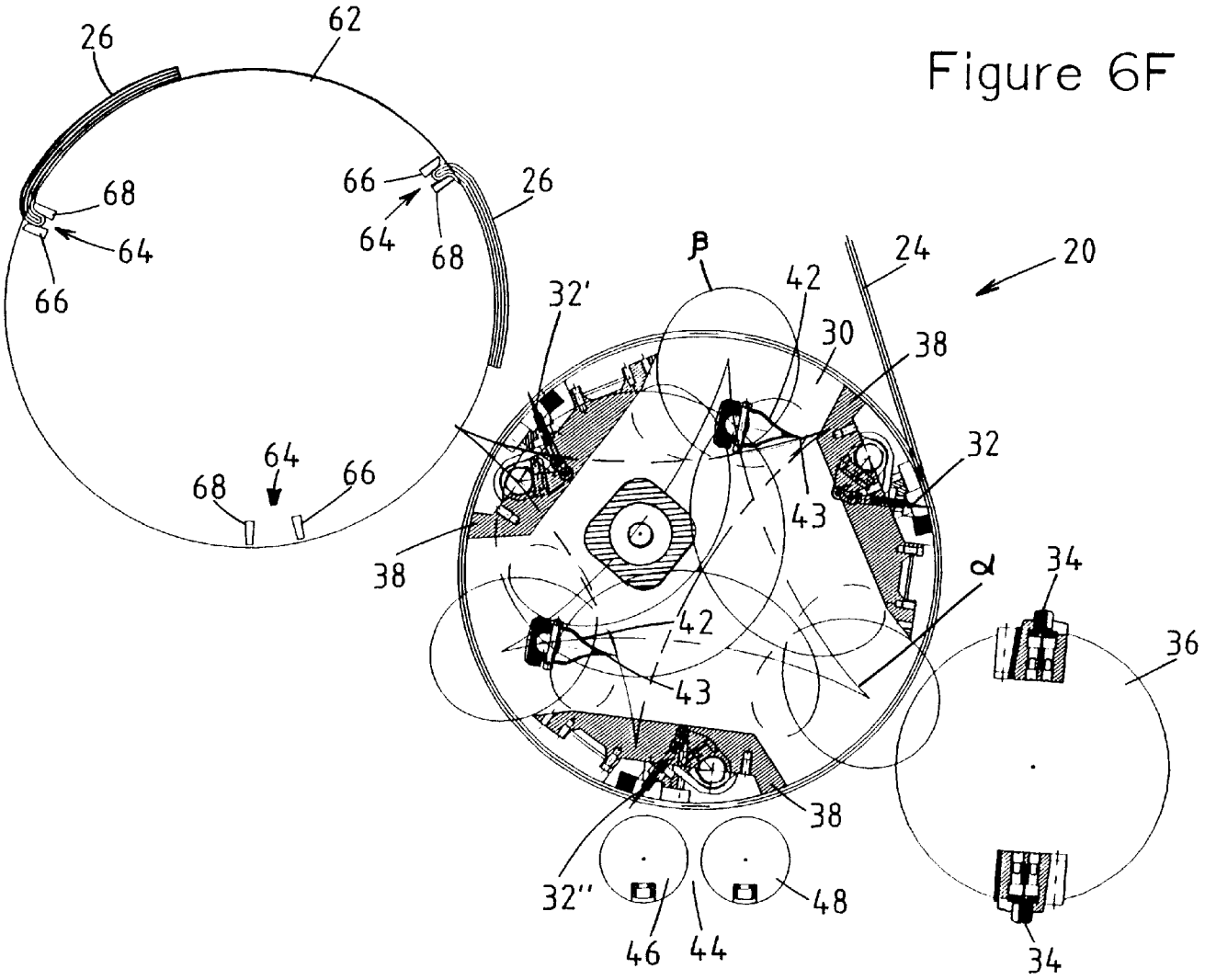
Figure 6G:
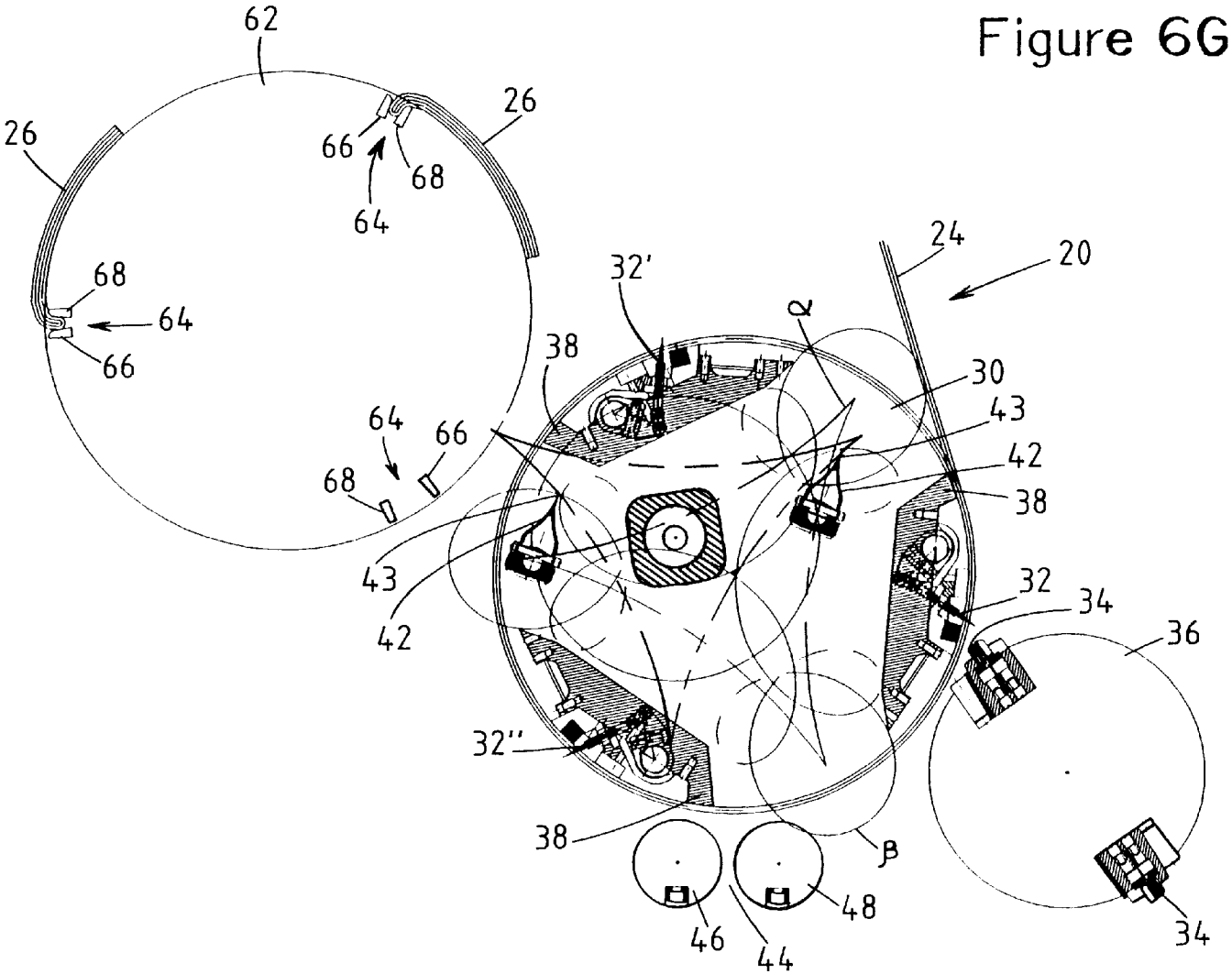

With regard to the mechanics of the spider assembly 82, FIGS. 3 and 4 depict the spider assembly 82 in detail. The spider assembly 82 is preferably a planetary gear system having a drive gear 84 rotating in the same direction as the folding cylinder 30. The drive gear 84 is motionless with respect to ground, but a drive device 86 rotates about the drive gear 84 in the direction indicated by arrow K. The drive gear 84 includes teeth 88 which mesh with teeth 90 of first and second intermediate gears 92. The teeth 90 of the intermediate gears 92 mesh with teeth 96 of first and second folding blade shafts 98, respectively. The first and second sets of folding blades 42 are attached to the first and second folding blade shafts 98, respectively. Therefore, rotation of the drive gear 84 in the direction of the arrow K causes rotation of the intermediate gears 92 in the same direction, which in turn causes rotation of the folding blade shafts 98 in the opposite direction as indicated by arrow L.

Given the respective diameters of the folding cylinder 30, the drive gear 84, the intermediate gears 92, and the folding blade shafts 98, it can be seen that the folding blade shafts 98 make multiple rotations for each individual rotation of the folding cylinder 30. This is illustrated by pathways a and a in FIGS. 5A–G and 6A–G, wherein the pathway designated by a indicates the motion of the folding blade shafts 98 with respect to ground, and the pathway designated by 0 indicates the motion of the folding blade tips 43 with respect to ground. By using first and second sets of folding blades 42 and the gear system described, one of the folding blades 42 extend beyond the periphery 83 (see FIG. 4) of the folding cylinder 30 at the location of the second fold rollers 46 and 48 upon every 1200 of rotation of the folding cylinder 30.

In FIGS. 3 and 5A–G the extension of the folding blades 42 beyond the periphery 83 of the folding cylinder 30 corresponds to the location of the nip 44. If, however, the user wishes to switch to jaw mode, the first and second sets of folding blades 42 can be extended radially outward beyond the periphery 83 of the folding cylinder 30 at a position corresponding to the location of the jaw cylinder 62. This is done by indexing the entire drive device 86 one hundred and twenty degrees clockwise from the position shown in FIGS. 5A–G to the position shown in FIGS. 6A–G to thus coordinate the extension of the folding blade 42 with the location of the jaw cylinder 62. Such indexing simply requires the drive gear 84, drive device 86, intermediate gears 92, and folding blade shafts 98 to be physically moved. After indexing, each set of folding blades 42 continues to extend radially outward after every 120° of rotation of the folding cylinder 30, but the folding blades 42 only extend beyond the periphery 83 of the folding cylinder 30 at the location of the jaw cylinder 62.

From the foregoing, it can therefore be seen that the disclosed apparatus and method are able to produce folded signatures from a moving web of material in either a rotary mode or a jaw mode to thus provide the beneficial features of both modes, while minimizing equipment requirements and enhancing physical access space to the press.

What is claimed is:

1. A printing press folder, comprising:

a frame, a moving web of printed material being adapted to move relative to the frame and be cut into individual signatures;

a folding cylinder mounted to the frame adapted to form the signatures, the folding cylinder including a folding blade adapted to extend radially therefrom to initiate a fold in each signature, the folding cylinder being configurable into either a rotary mode or a jaw mode;

a jaw cylinder mounted to the frame and positioned proximate the folding cylinder, the jaw cylinder including a plurality of clamp assemblies extending radially therefrom, each clamp assembly being adapted to receive the folding blade and a signature therein when the folding cylinder is in the jaw mode, the jaw cylinder being adapted to complete the fold; and a rotary mode assembly mounted to the frame and positioned proximate the folding cylinder, the rotary mode assembly including a pair of second fold rollers divided by a nip, the nip being adapted to receive the folding blade and a signature therein when the folding cylinder is in the rotary mode, the rotary mode assembly being adapted to complete the fold.

2. The printing press folder of claim 1 further including a cutting cylinder mounted to the frame and positioned proximate the folding cylinder, the cutting cylinder including a cutting blade adapted to cut the signatures from the moving web.

3. The printing press folder of claim 1 further including a first delivery fly and conveyor positioned proximate the jaw cylinder, and a second delivery fly and conveyor positioned proximate the rotary mode assembly, the first and second delivery flies and conveyors being adapted to receive and transport the folded signatures.

4. The printing press folder of claim 1 wherein the folding blade is connected to a timing mechanism, the timing mechanism being adjustable to cause the folding blade to extend into one of the clamp assemblies when in the jaw mode, and into the nip when in the rotary mode.

5. The printing press folder of claim 4 wherein the timing mechanism includes a planetary gear system.

6. The printing press folder of claim 4 wherein the folding blade is adapted to extend radially outward after every 120° of rotation of the folding cylinder, the jaw cylinder and rotary mode assembly being positioned 120° apart around the folding cylinder.

7. A folding couple for a printing press comprising:

a rotary mode assembly;

a jaw mode assembly; and means for directing a fold in a signature to either the rotary mode assembly or the jaw mode assembly.

8. The folding couple of claim 7 wherein the rotary mode assembly includes a pair of spaced rollers adapted to receive a folded signature therebetween.

9. The folding couple of claim 8 further including a delivery fly and a conveyor, the delivery fly being adapted to receive the folded signature and transport the folded signature to the conveyor.

10. The folding couple of claim 9 wherein the delivery fly includes a hub with a plurality of arcuate vanes extending therefrom.

11. The folding couple of claim 7 wherein the jaw mode assembly includes a rotating cylinder having a plurality of clamp assemblies extending therefrom, each clamp assembly being adapted to receive a folded signature therein.

12. The folding couple of claim 11 further including a delivery fly and a conveyor, the delivery fly being adapted to receive the folded signature and transport the folded signature to the conveyor.

13. The folding couple of claim 12 wherein the delivery fly includes a hub with a plurality of arcuate vanes extending therefrom.

14. The folding couple of claim 7 wherein the means for directing includes a folding cylinder with a spider assembly operably connected to the folding cylinder.

15. The folding couple of claim 14 wherein the spider assembly includes a movable folding blade.

16. The folding couple of claim 15 wherein the spider assembly is indexable to coordinate extension of the folding blade with the location of the jaw mode assembly and the rotary mode assembly.

17. The folding couple of claim 16 wherein the spider assembly includes a planetary gear system.

18. The folding couple of claim 16 wherein the spider assembly causes the folding blade to extend from the folding cylinder upon every 120° of rotation of the folding cylinder, the rotary mode assembly and jaw mode assembly being positioned 120° apart around the folding cylinder.

19. A method of producing folded signatures from a moving web of material comprising the steps of:

cutting the moving web into signatures;

creating a fold in the signature; and directing the fold to one of a rotary mode assembly and a jaw mode assembly, the rotary mode assembly and jaw mode assembly being provided on the same printing press.

20. The method of claim 19 wherein the cutting step is performed by a rotating cutting cylinder.

21. The method of claim 19 wherein the creating step is performed by the extension of a folding blade from a rotating folding cylinder about which the web is trained.

22. The method of claim 21 wherein the creating step is performed upon every 120° of rotation of the folding cylinder.

23. The method of claim 21 wherein the folding blade is operably connected to a spider assembly.

24. The method of claim 23 wherein the directing step is adjusted to direct the folded signature to one of the rotary mode assembly and the jaw mode assembly by indexing the spider assembly with respect to the folding cylinder.

25. The method of claim 24 wherein the rotary mode assembly and jaw mode assembly are spaced 120° apart around the folding cylinder.

* * * * *